US007674732B2

(12) United States Patent
Ito

(10) Patent No.: US 7,674,732 B2
(45) Date of Patent: Mar. 9, 2010

(54) FELT FOR PAPERMAKING

(75) Inventor: Yoshiaki Ito, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 545 days.

(21) Appl. No.: 11/630,035

(22) PCT Filed: Jun. 14, 2005

(86) PCT No.: PCT/JP2005/010840

§ 371 (c)(1),
(2), (4) Date: Dec. 19, 2006

(87) PCT Pub. No.: WO2006/001191

PCT Pub. Date: Jan. 5, 2006

(65) Prior Publication Data

US 2008/0070462 A1 Mar. 20, 2008

(30) Foreign Application Priority Data

Jun. 25, 2004 (JP) ..... 2004-187334

(51) Int. Cl.

| | |
|---|---|
| ***B32B 5/26*** | (2006.01) |
| ***B32B 5/06*** | (2006.01) |
| ***B32B 5/08*** | (2006.01) |
| ***B32B 5/12*** | (2006.01) |

(52) U.S. Cl. ..... 442/389; 442/352; 442/381; 442/387; 442/388; 442/402; 442/403; 442/407

(58) Field of Classification Search ..... 442/352, 442/381, 387, 388, 389, 402, 403, 407
See application file for complete search history.

(56) References Cited

U.S. PATENT DOCUMENTS

| | | | | |
|---|---|---|---|---|
| 4,565,735 | A * | 1/1986 | Murka et al. | 442/324 |
| 4,973,512 | A * | 11/1990 | Stanley et al. | 442/195 |
| 5,236,652 | A * | 8/1993 | Kidder | 264/211 |
| 5,783,501 | A | 7/1998 | Schuetze et al. | |

FOREIGN PATENT DOCUMENTS

| | | | |
|---|---|---|---|
| EP | 529506 | A1 * | 3/1993 |
| JP | 6-123094 | | 5/1994 |
| JP | 10-204788 | | 8/1998 |
| WO | 95/16810 | | 6/1995 |

* cited by examiner

*Primary Examiner*—Andrew T Piziali
(74) *Attorney, Agent, or Firm*—Wenderoth, Lind & Ponack, L.L.P.

(57) ABSTRACT

A felt for papermaking which is less prone to be crushed during operation of high speed paper machine, promptly begins stable papermaking after starting the machine, assures durability, and maintains surface smoothness.

13 Claims, 1 Drawing Sheet

[Fig.1]
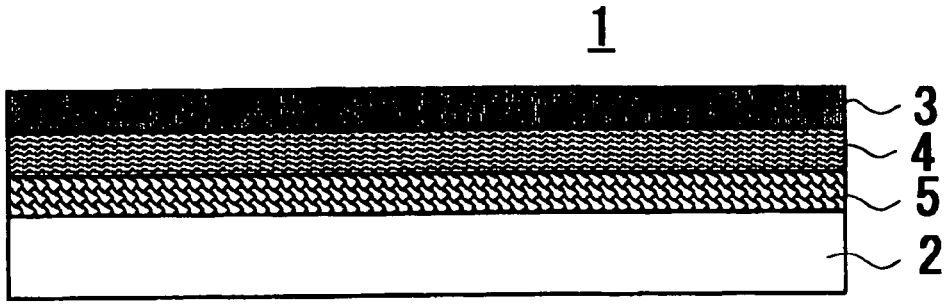
[Fig.2]
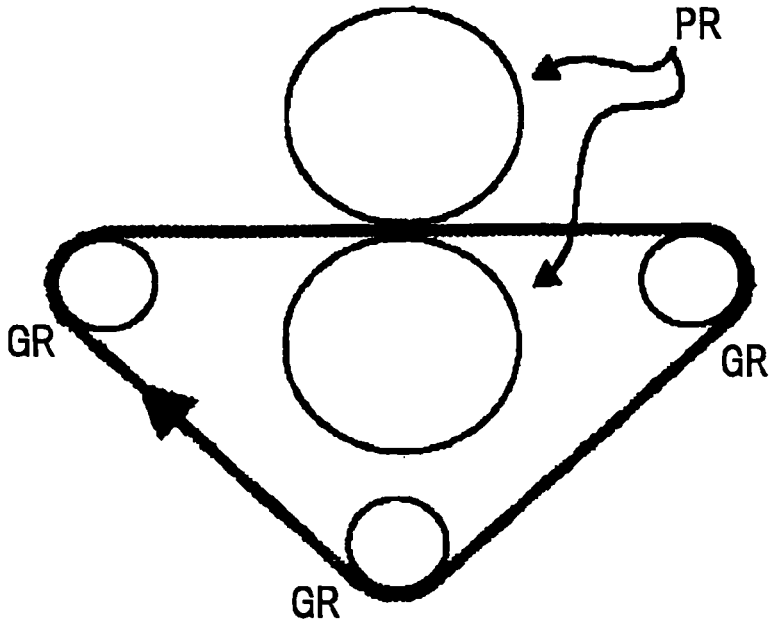

FELT FOR PAPERMAKING

BACKGROUND OF THE INVENTION (1) Field of the Invention

The present invention relates to a structure of felt for papermaking, specifically to an optimum structure of the felt used in a high speed tissue paper machine for assuring smoothness of the paper, prompt papermaking stability after beginning the operation of the machine, compatibility, and durability.

(2) Description of Related Art

For a paper machine, the structure of felt for papermaking used for dewatering of wet paper is ordinarily composed of a substrate made of seamless woven fabric, and a batt layer prepared by implanting batt fibers of short fibers onto the substrate by the needle-punch technique. There are provided structures of pluralities of batt layers for the above felt, (Patent Documents 1, 2, 3, and 4).

The above felt with a multilayer structure adopts thin fibers with small fineness as the uppermost layer of the felt, contacting with the wet paper. The reason for using small fineness fibers is to improve the smoothness of the uppermost layer which contacts the wet paper, so that the surface smoothness of the wet paper can be improved.

Since an intermediate layer between the uppermost layer of the felt and the substrate thereof does not contact the wet paper, relatively coarse fineness and rather thick fibers are used in the intermediate layer to keep the water permeability of the felt for a long period of time. With that structure, crush of the intermediate layer is suppressed during a specified use period of time, and the surface smoothness of the wet paper is improved to some degree.

[Patent Document 1] JP-A-50-43204, (the term "JP-A" referred to herein signifies the "Unexamined Japanese Patent Publication");

[Patent Document 2] JP-A-6-123094;

[Patent Document 3] JP-A-7-150496;

[Patent Document 4] BP Publication No. 2,200,867;

[Patent Document 5] JP-A-8-506863;

[Patent Document 6] JP-A-5-214694; and

[Patent Document 7] U.S. Pat. No. 6,175,996

BRIEF SUMMARY OF THE INVENTION

However, above-described technologies adopting two different kinds of batt layers are not satisfactory as the felt for papermaking used in recent high speed tissue paper machines. That is, recent high speed tissue paper machines are operated at significantly higher speeds compared with the conventional tissue paper machines, thus a felt is wanted which assures smoothness of the paper, prompt papermaking stability after beginning the operation of the machine, compatibleness, and durability. The existing felt, however, crushes in the intermediate layer within a short period of time after beginning operation, thus there may occur a phenomenon of marking the woven fabric pattern of the substrate, (surface irregularities resulting from rising and lowering of warp and weft), or unevenness of the basic weight of the crushed intermediate layer onto the wet paper surface.

The inventors of the present invention conducted detail studies about the above problems, and developed a felt for papermaking usable for a long period of time even in a high speed paper machine without deteriorating the surface smoothness of the wet paper by being less prone to crush the of batt fibers between the substrate and the uppermost layer.

The present invention provides a felt for papermaking having a substrate, and batt fiber layers, positioned on the wet-paper side of the substrate, being composed of at least three-layers of short fibers: a first layer as the uppermost layer; a second layer contacting with the first layer; and a third layer contacting with the second layer, wherein the average fineness of the short fibers of the batt fibers in each batt fiber layer is: 0.5 to 6 dtex for the first layer; 1.5 to 15 dtex for the second layer, coarser than the fineness in the first layer; and 6 to 30 dtex for the first layer, coarser than the fineness in the second layer. With the structure, the batt fibers in the second layer and in the third layer, being positioned as intermediate layers, are less prone to be crushed and have resistance to collapsing, while keeping good surface smoothness of the wet paper even in a high speed paper machine.

To further improve the effect of the present invention, it is preferable that, in addition to providing a difference in the fineness of the short fibers in the three batt fiber layers as described above, the batt fibers in the second layer and in the third layer adopt the fibers having higher molecular weight than that in the batt fibers in the first layer.

That is, in a more preferable embodiment of the present invention, the batt fibers are polyamide fibers, and the absolute viscosity of a solution of 0.25 g of the batt fibers in the first layer in 50 ml of JIS technical grade 95% sulfuric acid, at 25° C., is 60 to 70 mPa·S, and the absolute viscosity of a solution of 0.25 g of the batt fibers in the second layer and in the third layer, respectively, in 50 ml of the sulfuric acid, at 25° C., is 80 mPa·S or more.

In a preferable embodiment of the present invention, the batt fibers in the second layer and the batt fibers in the third layer penetrate the substrate while entangling therebetween, and the batt fibers in the first layer do not penetrate the substrate while entangling with the batt fibers in the second layer and in the third layer.

It is preferable that the batt fibers in the second layer and in the third layer have a three dimensional crimp.

The felt for papermaking according to the present invention has a laminated structure of a substrate and short fiber batt fiber layers being composed of at least three layers having different fineness of the fibers from one another. With the structure, the batt fibers in the intermediate layer becomes less prone to be crushed even in a high speed paper machine, and the felt is provided with stability for a long period of time of operation, in terms of sustained water permeability and compression recovery, thereby providing the felt with resistance to collapsing.

The felt for papermaking according to the present invention contains batt fiber layers composed of three layers of short fibers, each layer having different fineness of fibers from one another, on the substrate at the wet paper side, and each layer is structured by short fibers, having different fineness for each layer depending on the use object and the role.

BRIEF DESCRIPTION OF THE SEVERAL VIEWS OF THE DRAWINGS

FIG. 1 shows a laminate structure of the felt for papermaking of the present invention.

FIG. 2 shows a device for determining the compression recovery performance and resistance to collapsing.

DETAILED DESCRIPTION OF THE INVENTION

In FIG. 1, the felt for papermaking (1) is structured by the substrate (2) and the batt fiber layers (3), (4), and (5).

The substrate (2) is a base material to assure the strength of the felt, and plays a role of assuring dimensional stability during traveling in the paper machine. The substrate (2) uses a woven fabric prepared by spun yarn, monofilament, twisting, or multifilament of polyamide fiber or polyester fiber, and specifically preferable one is woven fabric of monofilament of or of twisting of polyamide fiber. The fineness of the fiber of woven fabric is approximately 200 to 2000 dtex for monofilament, and approximately 400 to 5000 dtex for twisting. The basic weight of the substrate (woven fabric) used in the felt for papermaking is arbitrarily selected in an approximate range from 300 to 800 g/m$^2$. Although a single layer of the substrate is satisfactory, two or more layers are applicable.

The batt fiber layers are structured by at least three layers: the first layer (3) positioned at uppermost layer and being contacting with the wet paper; the second layer (4) being contacting with the uppermost layer; and the third layer (5) being contacting with the second layer.

Since the first layer (3) directly contacts with the wet paper, it adopts small fineness, or thin, fibers to assure the surface smoothness of the wet paper, giving the fineness of the short fibers from 0.5 to 6 dtex, preferably from 1 to 3 dtex.

The third layer (5) is positioned directly above the substrate, and is prepared by implanting thick batt fibers, which are least prone to be crushed, thus to resist collapsing. Since the fibers structuring the substrate (woven fabric) are significantly thicker than the batt fibers, the woven fabric pattern of the substrate is likely transferred onto the wet paper. With the use of thick batt fibers, however, the transfer of the woven fabric pattern is prevented. To do this, coarse fibers are used which have the fineness of short fibers ranging from 6 to 30 dtex, preferably from 10 to 15 dtex.

As described above, the respective batt fiber layers are applied to each of the first layer contacting with the substrate and the third layer contacting with the wet paper. The batt fiber layers are structured by short fibers having significantly different fineness between the first layer and the third layer, 1 to 3 dtex and 10 to 15 dtex, respectively, depending on the respective objectives. If, however, those two layers are directly laminated, the short fibers of thin fineness and the short fibers of thick fineness have poor entanglement performance so that the falling-out of the short fibers of the batt fibers in the uppermost layer in the felt is enhanced. To this point, the present invention positions the second layer (4) composed of short fibers of relatively coarse but medium degree of fineness, ranging from 1.5 to 15 dtex, preferably from 3 to 10 dtex, between the first layer and the third layer, thus improving the entanglement between the first layer and the second layer, and between the second layer and the third layer to increase the total entanglement.

The fineness of the short fibers of the batt fibers in the first through the third layers is within the above range, respectively. It is, however, necessary that the relation of the fineness of short fibers therebetween is the smallest in the first layer, becoming large in an order of from the second layer to the third layer.

The batt fiber layers of the felt for papermaking according to the present invention are structured by laminating at least the above three layers as the essential components. However, another fiber layer may be added as needed.

In addition to the substrate and the batt fiber layers, the felt for papermaking may have, as needed, another fiber layer, for example a fiber layer at rear face of the base cloth.

To provide the batt fiber layers on the substrate at a wet paper side with compressibility and recovery characteristics, and further with difficulty in collapsing throughout the operating period, and to increase promptly the surface smoothness in initial stage of the felt use, it is effective to give a difference in the molecular weight between the batt fibers in the first layer and the batt fibers in the second and the third layers, increasing the molecular weight of the batt fibers in the second and the third layers than that in the first layer. The batt fibers in the first layer are preferably low molecular weight batt fibers which are poor in the compressibility and the recovery characteristics and are likely collapsed to attain prompt stability of papermaking, or compatibility to improve the surface smoothness in the initial stage of felt use.

On the other hand, the batt fibers in the second and the third layers are preferably high molecular weight batt fibers which have high compressibility and recovery characteristics, and less prone to be crushed. With those structures, a felt having high functionality and durability is obtained.

That is, when polyamide fibers are used as the batt fibers, it is preferable that the absolute viscosity of a solution of 0.25 g of the batt fibers in the first layer in 50 ml of JIS technical grade 95% sulfuric acid, at 25° C., is 60 to 70 mPa·S, and the absolute viscosity of a solution of 0.25 g of the batt fibers in the second and in the third layers, respectively, in 50 ml of the sulfuric acid, at 25° C., is 80 mPa·S or more.

For general-use nylon fibers, the absolute viscosity of a solution 0.25 g thereof in 50 ml of JIS technical grade 95% sulfuric acid, at 25° C., is in a range from 60 to 70 mPa·S, and most of the industrial fibers have that in a range from 70 to 75 mPa·S. The polyamide fibers used in the batt fibers in the second and the third layers of the present invention have higher viscosity (higher molecular weight) than above. Accordingly, by providing differences not only in the fineness but also in the molecular weight for the polyamide fibers between the first layer and the second and third layers, they are fully functional as the base material for the felt for papermaking in the recent high speed tissue paper machines.

The use of high viscosity polyamide fibers as the felt for papermaking is disclosed in Patent Document 5. The disclosure proposes only the use of high viscosity polyamide fibers common to the substrate and the batt fibers in each layer, and does not suggest providing differences in molecular weight between the pluralities of layers in the batt fiber layer.

With the three layered structure of the batt fiber layers, composed of short fibers having different fineness in each layer, the surface smoothness is improved and further the batt fiber layers become less prone to be crushed, and further with specifying the state of entanglement between the batt fibers in the first through third layers and between the batt fibers in these layers and the substrate, the effect of the present invention becomes further significant.

That is, according to a further preferred embodiment of the present invention, the batt fibers in the second and the third layers penetrate the substrate while entangling with each other, and further the batt fibers in the first layer do not penetrate the substrate while entangling with the second and the third layers.

With the above structure, the batt fibers in the second and the third layers penetrate the substrate so that sufficient adhesion is attained, and the fibers do not fall-off to adhere to the wet paper in the dewatering stage, and further the batt fibers in the first layer do not adhere to the substrate. Consequently, the structure contributes to the smoothness of the wet paper, while assuring the compressibility, the recovery characteristics, and the thickness of the three layer structure on the substrate at the wet paper side, thus providing totally the batt fibers on the substrate at the wet paper side with the resistance to collapsing.

The reason to attain the effect is that, since the batt fibers in the first layer have a felt structure which does not adhere to the substrate, the felt does not become totally dense, and only the uppermost layer of the felt forms the high density and compact batt fiber layer, thus the batt fibers in the first layer shows excellent surface smoothness, and further the batt fibers in the second and the third layers inside the felt have high compressibility and recovery characteristics, and are less prone to be collapsed, though they penetrate the substrate. Therefore, the water permeability and the compression recovery are sustained, and the resistance to collapsing can be given to the felt.

The felt for a paper machine, structured by the substrate and lamination of the three layers of batt fiber layers, according to the present invention can be manufactured by laminating the third layer, the second layer, and the first layer successively on the substrate, and then by integrating them by needling. To manufacture a felt having the structure that the above-described fibers in the second and the third layers penetrate the substrate and that the fibers in the first layer do not penetrate the substrate, it is preferred to overlay the batt fiber layer of the first layer on the second layer to integrate them by needling while adjusting the needle depth to a shallow level not to penetrate the substrate, or by needling the first layer using a needle board having a curved plane as described in Patent Document 7 (U.S. Pat. No. 6,175,996).

The short fibers to structure the batt fiber layer of above first to third layers use synthetic fibers such as polyamide fibers and polyester fibers, and natural fibers such as wool. From the point of resistance to wear, resistance to chemicals, and resistance to heat, however, short fibers of polyamide are preferred. The basic weight of each batt fiber layer is, though depending on the fineness of the short fibers, preferably adjusted to an approximate range from 50 to 200 g/m$^2$ in the first layer, 100 to 200 g/m$^2$ in the second layer, and 100 to 200 g/m$^2$ in the third layer.

By providing a three-dimensional crimp to the batt fibers in the second and the third layers, the effect of the present invention further improves. Since the conventional batt fibers having sawtooth shape crimp give flat stretch within the batt fiber layer, there cannot be attained the sustained high compressibility, recovery characteristics, and thickness, or resistance to collapsing. Patent Document 6 proposes a felt for paper machine, which felt is made of a base cloth and fiber fleeces, and the total or a part of the fiber fleeces is crimped into a three-dimensional shape. By applying the felt to the three-layered batt fiber structure of the present invention, the sustainability of compressibility, recovery characteristics, and thickness of the three-layered structure on the substrate at the wet paper side can significantly be improved.

There are known methods to manufacture the batt fibers having three-dimensional crimp, which include the following ones, (Patent Document 6).

(1) Use of different kinds of bicomponent composite fibers: three-dimensional crimp is attained by the difference in the physical properties such as expansion rate, shrinking behavior, and water absorbency (Koch, P. A: Chemiefasern/Textilind. pp. 431-438, (1979)).

(2) Air-jet or steam-jet texture processing: (H. Schellenberg: 3. Reutlinger Texturier-Kolloquium (1984)).

(3) Method of asymmetrical cooling on melt-spinning: providing a mixture of polymers having different physical properties from each other, thus inducing three-dimensional crimp similar to that in the bicomponent fibers.

EXAMPLES

Examples 1 to 3

(1) Substrate: After primary-twisting two monofilaments (360 dtex) in the S direction, three units of the twisted filaments were treated by final-twisting in the Z direction to prepare a twisting. A woven fabric was prepared by hollow-weaving thus prepared twisting as the warp and the weft in a weaving machine, (500 g/m$^2$ of basic weight), for common to Examples and Comparative Examples.

(2) Batt fiber layers: The fiber sheets given in Table 1 were prepared.

| | | Material | Fiber form[1] | Viscosity of sulfuric acid solution[2] (mPa) · S | Short fiber fineness (dtex) | Basic weight (g/m$^2$) | Entanglement |
|---|---|---|---|---|---|---|---|
| Example 1 | First layer | 6-Nylon | Sawtooth-shape crimp | 65 | 2 | 200 | Down to the third layer |
| | Second layer | 6-Nylon | Three-dimensional crimp | 80 | 10 | 200 | Down to the woven fabric |
| | Third layer | 6-Nylon | Three-dimensional crimp | 80 | 15 | 200 | Down to the woven fabric |
| Example 2 | First layer | 6-Nylon | Sawtooth-shape crimp | 65 | 2 | 200 | Down to the third layer |
| | Second layer | 6-Nylon | Three-dimensional crimp | 80 | 10 | 200 | Down to the woven fabric |
| | Third layer | 6-Nylon | Sawtooth-shape crimp | 80 | 15 | 200 | Down to the woven fabric |
| Example 3 | First layer | 6-Nylon | Sawtooth-shape crimp | 65 | 3 | 200 | Down to the woven fabric |
| | Second layer | 6-Nylon | Three-dimensional crimp | 80 | 7 | 200 | Down to the woven fabric |
| | Third layer | 66-Nylon | Three-dimensional crimp | 80 | 13 | 200 | Down to the woven fabric |

[1]The nylon fibers in three-dimensional crimp were prepared by the steam-jet texture method. The crimp in a sawtooth shape was prepared by the processing method using a stuffer-box (pushing-in box).
[2]Viscosity of sulfuric acid solution: A solution of 0.25 g of batt fibers in 50 ml of JIS technical grade 95% sulfuric acid was prepared, and the absolute viscosity was determined at 25° C. using an oscillation plate viscometer.

On the above-described substrate, the batt fiber layers were laminated in the order of the third layer and the second layer, which laminated layers were subjected to needling using a commercially available needles for needle-punching to a depth penetrating the substrate (woven fabric). After that, the first layer was further laminated, and needling was applied so as the batt fibers in the first layer to stop in the third layer of the batt fiber layer, thus obtained the felt in which the substrate and the three batt fiber layers were laminated.

Among the batt fiber layers structuring the felt, the batt fibers in the second and the third layers were entangled with each other, and penetrated the substrate. On the other hand, although the batt fibers in the first layer entangled with the second and the third layers, the felt of Example 1 and Example 2 did not allow the batt fibers in the first layer to penetrate the substrate. For the felt of Example 3, the batt fibers in the first layer penetrated the substrate.

From the viewpoint of smoothness, compressibility, and recovery characteristics of the wet paper, the structures of Example 1 and Example 2 are superior.

The entanglement state between batt fibers and between batt fibers and substrate was confirmed by the following test. That is, the felt was immersed in an aqueous solution of 0.05% by weight of acidic dyestuff, which was then boiled, followed by washing with water and drying. A cross section of thus prepared felt was observed using a light microscope. Since the batt fibers in the first layer were lower in the viscosity in sulfuric acid solution (lower molecular weight), and since they had thinner fineness than those of other batt fibers, they were dyed stronger. Therefore, the state of entanglement of fibers between layers and penetration thereof can easily be observed.

Comparative Example 1

As of the three batt layer structure in Example 1, the first and the third layers were directly laminated, (Table 2), except for not-applying the second layer, and applying needling to them so as both the first and the third layers to stop in the woven fabric, thus prepared a felt structured by the substrate and two batt layers.

Comparative Examples 2 and 3

Without applying the second layer, there was prepared a felt structured by the substrate and two layers of 6-nylon and 66-nylon, respectively, and also prepared a felt structured by the substrate and two layers of 66-nylon, which are given in Table 2.

For the respective felts for papermaking prepared in Examples 1 to 3 and Comparative Examples 1 to 3, evaluation was given to the surface smoothness, compression recovery performance, and resistance to collapsing using the following respective methods.

(1) Surface Smoothness Test

In accordance with JIS B061-1982 ("Surface roughness"), the evaluation was given in terms of surface roughness (Rz) of the felt for papermaking. Lower values mean smaller surface irregularities as the surface roughness and higher smoothness.

(2) Compression Recovery Performance and Resistance to Collapsing Test

A felt was passed through the experimental apparatus shown in FIG. 2 to determine the felt thickness at each stage of non-loading during initial period, under compression by press rolls, and after pressure-released using sensors. The compression rate and the recovery rate were calculated by the following formulae, thus evaluated the compression recovery performance of the felt and the performance of sustained recovery (resistance to collapsing).

Compression rate (%)=(Felt thickness under compression/Felt thickness under non-loading in the initial period)×100

Recovery rate (%)=(Felt thickness immediately after pressure release/Felt thickness under compression)×100

As shown in FIG. 2, the experimental apparatus has a pair of press-rolls PR, a plurality of guide rolls GR to support the felt applying a specified tension thereto, a sensor (not shown) to determine the felt thickness under loading by the press-rolls, and a second sensor (not shown) to determine the felt thickness immediately after releasing the pressure. The operating condition of the experimental apparatus was 100 kg/cm of pressing force and 1000 m/min of felt drive speed. The evaluation was given to the compression recovery performance after 50 hours of felt drive and to the resistance to collapsing owing to the felt thickness after 120 hours of felt drive.

The evaluation of the resistance to collapsing was given by a relative evaluation on the felt thickness after 120 hours of felt drive in Examples and Comparative Examples. The value in Comparative Example 1 was set to 3 as the basis. Compared with the 3 points, higher points were ranked to GOOD, and lower points were ranked to BAD. Larger values were evaluated as better ranking. The result with the above evaluation method is given in Table 3.

TABLE 2

| | | Material | Fiber form(1) | Viscosity of sulfuric acid solution(2) (mPa) · S | Short fiber fineness (dtex) | Basic weight (g/m$^2$) | Entanglement |
|---|---|---|---|---|---|---|---|
| Comparative Example 1 | First layer | 6-Nylon | Sawtooth-shape crimp | 65 | 2 | 200 | Down to the woven fabric |
| | Second layer | None | — | — | — | — | — |
| | Third layer | 6-Nylon | Three-dimensional crimp | 80 | 15 | 200 | Down to the woven fabric |
| Conparative Example 2 | First layer | 6-Nylon | Sawtooth-shape crimp | 60 | 2 | 200 | Down to the woven fabric |
| | Second layer | None | — | — | — | — | — |
| | Third layer | 66-Nylon | Sawtooth-shape crimp | 65 | 10 | 200 | Down to the woven fabric |
| Conparative Example 3 | First layer | 66-Nylon | Sawtooth-shape crimp | 80 | 2 | 200 | Down to the third layer |
| | Second layer | None | — | — | — | — | — |
| | Third layer | 66-Nylon | Sawtooth-shape crimp | 80 | 15 | 200 | Down to the woven fabric |

TABLE 3

| | Example 1 | Example 2 | Example 3 | Conparative Example 1 | Conparative Example 1 | Conparative Example 1 |
|---|---|---|---|---|---|---|
| Surface smoothness test | 40 μm | 40 μm | 45 μm | 60 μm | 60 μm | 55 μm |
| Compression recovery performance and resistance to collapsing test | 37/31 | 35/28 | 34/28 | 32/26 | 30/25 | 30/25 |
| evaluation of the resistance to collapsing | 5 | 5 | 4 | 3 | 2 | 2 |

As seen in Table 3, the felts in Examples 1 to 3, laminating three batt fiber layers gave superior result of surface smoothness test to the felts in Comparative Examples 1 to 3. Furthermore, the batt fiber layers of the second and the third layers were less prone to be crushed, giving excellent compression recovery performance and resistance to collapsing.

INDUSTRIAL APPLICABILITY

The felt for papermaking according to the present invention is structured by the substrate and at least three layers of short fiber batt fiber layers. The first layer contacting directly with the wet paper uses short fibers with small fineness to assure the surface smoothness of the wet paper. The third layer which contacts with the substrate and which is requested to be least prone to be crushed is prepared by implanting thick batt fibers of short fibers with large fineness. Between the first layer and the third layer, a batt fiber layer of short fibers having medium fineness is positioned. Preferably the batt fibers in the second and the third layers use fibers having higher molecular weight than that of the batt fibers in the first layer.

According to an optimum embodiment of the present invention, the batt fibers in the second and the third layers penetrate the substrate while entangling with each other, and the batt fibers in the first layer do not penetrate the substrate while they are entangling with the second and the third layers. Furthermore, the batt fiber layer of the second and the third layers use three-dimensionally crimped fibers. With that laminated structure, total felt becomes less prone to be crushed even in a high speed paper machine, and is applicable to a use for a long period of time. In addition, since the surface smoothness in the initial period of felt use is good, the wet paper with smooth surface is obtained. Therefore, the present invention provides an excellent felt for papermaking suitable for the paper machines, specifically the high speed tissue paper machines.

The invention claimed is:

1. A felt for papermaking, the felt comprising:

a substrate; and batt fiber layers positioned on a wet-paper side of the substrate, the batt fiber layers being composed of three layers of short fibers including (i) a first layer which is an uppermost layer, (ii) a second layer which contacts the uppermost layer, and (iii) a third layer which contacts the second layer, wherein the average fineness of the short fibers of batt fibers in the first layer is 0.5 to 6 dtex, the average fineness of the short fibers of batt fibers in the second layer is 1.5 to 15 dtex, and the average fineness of the short fibers of batt fibers in the third layer is 6 to 30 dtex, wherein the batt fibers are polyamide fibers, wherein the absolute viscosity of a solution of 0.25 g of the batt fibers of the first layer in 50 ml of JIS technical grade 95% sulfuric acid, at 25° C., is 60 to 70 mPa·S, wherein the absolute viscosity of a solution of 0.25 g of the batt fibers of the second layer in 50 ml of JIS technical grade 95% sulfuric acid, at 25° C., is 80 or more mPa·S, and wherein the absolute viscosity of a solution of 0.25 g of the batt fibers of the third layer in 50 ml of JIS technical grade 95% sulfuric acid, at 25° C., is 80 mPa·S or more.

2. The felt of claim 1, wherein the average fineness of batt fibers in the first layer is 1 to 3 dtex, the average fineness of batt fibers in the second layer is 3 to 10 dtex, and the average fineness of batt fibers in the third layer is 10 to 15 dtex.

3. The felt of claim 1, wherein the batt fibers in the second layer penetrate and the batt fibers in the third layer penetrate the substrate and are entangled therebetween, and wherein the batt fibers in the first layer do not penetrate the substrate and are entangled with the batt fibers in the second layer and the batt fibers in the third layer.

4. The felt of claim 1, wherein the batt fibers in the second layer and the batt fibers in the third layer have a three dimensional crimp.

5. The felt of claim 2, wherein the batt fibers in the second layer penetrate and the batt fibers in the third layer penetrate the substrate and are entangled therebetween, and wherein the batt fibers in the first layer do not penetrate the substrate and are entangled with the batt fibers in the second layer and the batt fibers in the third layer.

6. The felt of claim 5, wherein the batt fibers in the second layer and the batt fibers in the third layer have a three dimensional crimp.

7. The felt of claim 2, wherein the batt fibers in the second layer and the batt fibers in the third layer have a three dimensional crimp.

8. The felt of claim 1, wherein the second layer and the third layer are disposed between the first layer and the substrate.

9. The felt of claim 1, wherein the first layer is a paper contacting layer, and the substrate is a guide roller contacting layer.

10. The felt of claim 9, wherein the second layer and the third layer are disposed between the first layer and the substrate.

11. The felt of claim 2, wherein the second layer and the third layer are disposed between the first layer and the substrate.

12. The felt of claim 2, wherein the first layer is a paper contacting layer, and the substrate is a guide roller contacting layer.

13. The felt of claim 12, wherein the second layer and the third layer are disposed between the first layer and the substrate.

* * * * *